United States Patent [19]

Oguchi et al.

[11] 3,967,485

[45] July 6, 1976

[54] METHOD FOR EXTRUDING BRITTLE MATERIALS

[75] Inventors: Atsushi Oguchi, Tokyo; Minoru Otaguchi, Hino; Minoru Nobuki, Higashikurume; Yoshinari Kaieda, Tokyo, all of Japan

[73] Assignee: National Research Institute for Metals, Tokyo, Japan

[22] Filed: Jan. 31, 1975

[21] Appl. No.: 545,875

[30] Foreign Application Priority Data

Feb. 2, 1974 Japan ..... 49-13306

[52] U.S. Cl. ..... 72/60; 72/271

[51] Int. Cl.[2] ..... B21C 23/00

[58] Field of Search ..... 72/54, 56, 271, 60, 72/272, 259; 29/421

[56] References Cited

UNITED STATES PATENTS

| | | | |
|---|---|---|---|
| 2,936,520 | 5/1960 | De Sternberg | 72/54 |
| 3,354,685 | 11/1967 | Green | 72/271 X |
| 3,392,562 | 7/1968 | Fuchs, Jr. | 72/271 X |
| 3,538,730 | 11/1970 | Alexander et al. | 72/60 |
| 3,553,996 | 1/1971 | Sabraff et al. | 72/60 |

*Primary Examiner*—Milton S. Mehr
*Attorney, Agent, or Firm*—Sherman & Shalloway

[57] ABSTRACT

A method for extruding a billet made of brittle metals, alloys, intermetallic compounds, ferrites or ceramics, which comprises embedding the billet in a solid pressure transmitting medium having a configuration and a dimension fitting to those of the inner space of a container of an extruder and being capable of plastic deformation by the actuating pressure of a compressing plunger of the extruder, loading the billet in the container of the extruder, pressurizing the pressure transmitting medium by the compressing plunger, and extruding the billet by actuating the extrusion plunger while the pressure is being maintained.

12 Claims, 7 Drawing Figures

Fig. 4-A
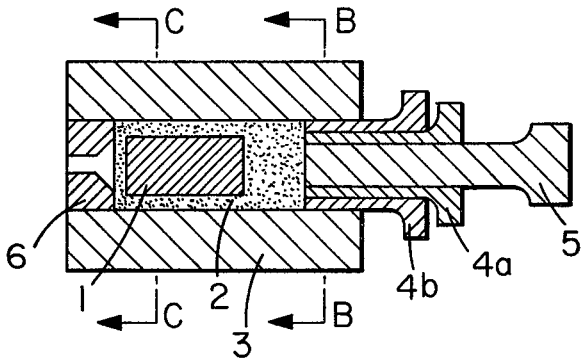
Fig. 4-C
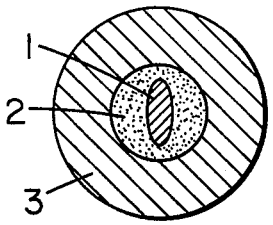
Fig. 4-B
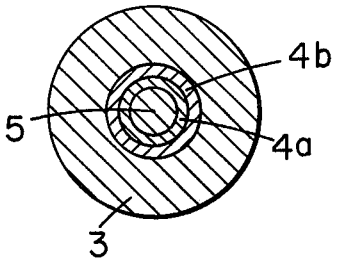
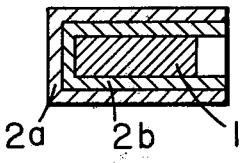
Fig. 5

METHOD FOR EXTRUDING BRITTLE MATERIALS

This invention relate to a method for extruding metals or alloys, especially brittle metals or alloys, intermetallic compounds, ferrites or ceramics.

Many metals or alloys can be extruded by an extruder into a linear or rod-like form from their billets, and methods of such extrusion are already known.

In conventional methods for extruding metals or alloys, the billets are plastically deformed in the container of an extruder by the pressure of an extrusion plunger to fill the container, and then extruded through a die. However, certain kinds of metals or alloys have such low plasticity that when subjected to the pressure of the extrusion plunger within the container, they become broken before being sufficiently deformed so as to fill the container. The same can be said with regard to the intermetallic compounds, ferrites and ceramics.

In order to make it possible to extrude brittle materials, a hydrostatic extrusion method was previously proposed in which the surrounding space of the billet in the container is filled with a liquid, and then the liquid is compressed to exert a hydrostatic pressure on the billet thereby to extrude the billet through a die (Journal of the Institute of Metals, 93, 1964–65, pages 201 to 217).

This hydrostatic extrusion method, however, suffers from the defect that the processing temperature is limited to points in the vicinity of room temperature, and hot extrusion cannot be performed.

Additionally it is very dangerous since an enormous amount of energy in the compressed liquid is built up.

Accordingly, it is an object of this invention to provide a method for extruding a billet made of a brittle material, either hot or cold.

Another object of this invention is to provide a safe method for extruding a billet made of a brittle material.

The above objects of this invention can be achieved by a method for extruding a billet consisting of at least one material selected from the group consisting of metals, alloys, intermetallic compounds, ferrites and ceramics using an extruder including an extrusion die, an extrusion plunger and a container adapted to load the billet therein and extrude it therefrom, thereby to shape the billet to the configuration of the extrusion die; characterized in that said extruder further includes means for pressurizing said material loaded in the container as enclosed therein, and said method comprises embedding said billet made in a smaller dimension in all directions than the dimension of the internal space of said container in a solid pressure transmitting medium made of a material capable of being plastically deformed by the pressure exerted by said pressurizing means and having a configuration and dimension fitting to those of the internal space of said container, loading said pressure transmitting medium and said billet into the container, pressurizing said pressure transmitting medium and said billet by said pressurizing means, and then extruding said billet by the extrusion plunger while said pressure is maintained.

According to the method of this invention, the billet is extruded while in a state of being pressurized from its surrounding by means of the solid pressure transmitting medium, and therefore, billets made of brittle materials and having low plasticity can be extruded without being broken by the extrusion pressure of the extrusion plunger.

Embodiments of the present invention are described by reference to the accompanying drawings in which:

FIG. 4A is a view showing a modified type of the extruder shown in FIG. 1 which is suitable for extruding a billet having a non-circular cross section;

FIGS. 4B and 4C are cross sectional views taken respectively at lines B and C of FIG. 4A; and FIG. 5 is a sketch showing a modified form of the solid pressure medium suitable for hot extrusion.

Figure 1:
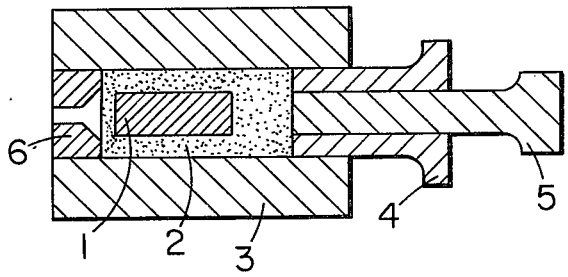
FIG. 1 is a schematic view showing the section of an extruder suitable for performing the method of this invention.
Figure 2:
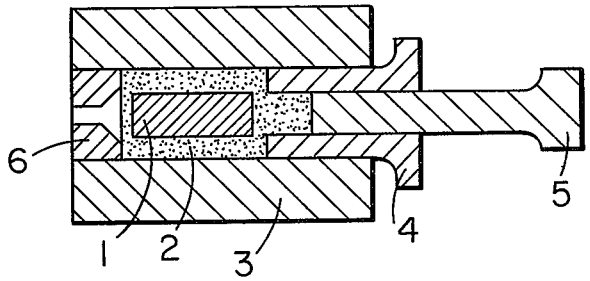
FIGS. 2 and 3 are sketches showing the operation of the extruder shown in FIG. 1.
Figure 3:
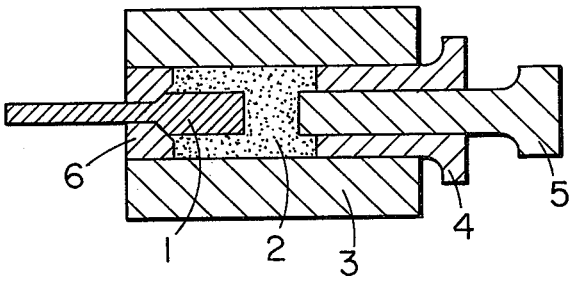

Referring to FIGS. 1 to 3, the extruder comprises a solid pressure transmitting medium 2, a container 3, a pressurizing plunger 4 for pressurizing the pressure medium 2, an extrusion plunger 5 and a die 6 with a billet 1 within the container 3. The pressurizing plunger 4 is provided coaxially in contact with and surrounding plunger 5, and can be operated independently of the extrusion plunger 5. The periphery of the plunger 4 makes contact with the inner wall of the container 3.

The billet 1 is embedded in the solid pressure transmitting medium 2, and loaded in the space of the container 3, as shown in FIG. 1.

The dimension of the billet 1 is smaller than that of the inner space of the container 3 in all directions. The solid pressure transmitting medium 2 can be shaped by compression molding of a powdery material so that its outer shape and dimension fit the inner space of the container 3, and it has an inner space therein for embedding the billet 1.

When the pressurizing plunger 4 is inserted into the container as shown in FIG. 2, the pressure medium 2 around the billet 1 is compressed to produce a pressure by which the billet 1 is pressurized from its surrounding. After the pressure within the container 3 has reached a predetermined value, further insertion of the pressurizing plunger 4 is stopped, and the extruding plunger 5 is inserted as shown in FIG. 3. Thus, the billet 1 is extruded through the die 6. At this time, the pressurizing plunger 4 is placed in position so as to maintain the pressure of the pressure transmitting medium 2 around the billet 1 at a predetermined value. The diameter of the extruding plunger 5 should be made substantially the same as that of the cross section of the billet 1. If the diameter of the extruding plunger 5 is larger than the cross sectional diameter of the billet 1, the pressure transmitting medium 2 is also extruded as adhering to the peripheral surface of the billet material, thus causing the quality of the extrudate to deteriorate.

The solid pressure transmitting medium to be used in this invention should be one which deforms within the space of the container by the pressure of the pressurizing plunger and can exert a pressure on the billet embedded therein. Examples of the pressure transmitting media that can be used in this invention are powders of molybdenum disulfide, pyrophyllite and talc; a powdery mixture of alumina or magnesia and molybdenum disulfide; and pyrophyllite and talc in lump form. The powdery material can be shaped into the desired pressure transmitting medium by compression molding, and the lumpy material, by machining.

The pressure to be exerted on the billet from its surrounding through the pressure transmitting medium should be one sufficient to withstand the extruding pressure applied to the billet at the time of extrusion and to protect the billet from breakage. Preferably, this pressure is generally at least 3000 Kg/cm$^2$, although it may differ according to the material of the billet, and higher pressures are preferred.

By the method of this invention, metals or alloys, especially highly brittle metals or alloys, intermetallic compounds, ferrites and ceramics can be extruded. The method of this invention is especially suitable for processing difficult materials that cannot be extruded by conventional extrusion methods, such as magnesium, zirconium, a Fe-Al-Si (Al:6, Si:10) alloy known as the Sendust alloy, ferrites, and intermetallic compounds such as Fe-Al or Zr-Rh. It is especially suitable for hot extruding the Sendust alloy.

The above billet can be produced by known methods. For example: magnesium can be formed into a billet by casting it into a cylindrical shape or by machining; the Sendust alloy can be cast into a cylindrical form; the ferrite can be formed into a billet by a powder metallurgical method; and high-melting alloys can be formed into billets by cutting from a button ingot.

The cross-sectional shape of the billet need not be completely circular. Even when the cross-sectional shape is non-circular, the billet can be pressurized from its surrounding by the effect of the pressure transmitting medium, and can be shaped into the desired configuration through a die.

FIG. 4 shows an example of an extruder suitable for extruding a billet having an elliptical cross-section by the method of this invention. FIG. 4-A is a sectional view taken along the direction parallel to the extrusion axis of the extruder; FIG. 4-B is a cross sectional view along the line B—B of FIG. 4-A in a direction at right angles to the extrusion axis; and FIG. 4-C is a cross-sectional view taken along the line C—C of FIG. 4-C in a direction at right angles to the extrusion axis of the extruder.

The extruder shown in FIG. 4 is of the type resulting from coaxially dividing the pressurizing plunger 4 of the extruder of FIG. 1 into two sections, one section in contact with the extrusion plunger 5 being shown by 4*a* and the other in contact with the inner wall of the container 3 being shown by 4*b*. The inside diameter of the pressurizing plunger 4*b* is substantially equal to the long axis of the cross section of the billet 1, and the diameter of the extrusion plunger 5 is substantially equal to the short axis of the cross-section of the billet 1. The operations of the pressurizing plunger 4*b* and the extrusion plunger 5 are the same as those shown in FIG. 1, and the operation of the pressure-maintaining plunger 4*a* is independent from those of the extrusion plunger 5 and the pressurizing plunger 4*b*. The pressure-maintaining plunger 4*a* is not inserted into the container, but remains positioned at the original point during the operation of the extrusion plunger and acts only to maintain the pressure applied to the inside of the container.

The extruder shown in FIG. 4 can extrude a billet having an elliptical cross-section without simultaneously extruding the pressure transmitting medium.

The method of this invention can be applied not only to cold extrusion but also to hot extrusion.

For hot extrusion, the use of a solid pressure transmitting medium divided into two sections, such as the type shown in FIG. 5, is preferred. In FIG. 5, the solid pressure transmitting medium 2 consists of an outer cylinder 2*a* and an inner cylinder 2*b* with the inner cylinder 2*b* being fitted tightly to the outer cylinder 2*a*, and has a space therein for accomodating the billet 1.

First, only the outer cylinder 2*a* is placed in the space of the container 3 of the extruder, and the billet 1 is accomodated in the inner cylinder 2*b* and heated together with the inner cylinder 2*b* to a predetermined temperature in a conventional heating furnace. The heated inner cylinder 2*b* with the billet 1 therein is then fitted in the outer cylinder 2*a* in the container 3, and then the extruder is actuated in the same manner as described above. In this way, the billet can be hot extruded while being maintained at a predetermined temperature during the extrusion without direct contact with the low-temperature pressure transmitting medium.

Whilst we have described the method of this invention in which the material within the container is pressurized by a pressurizing plunger, this pressurization operation can also be carried out using a container made of sliding anvils, by exerting pressure through the inward sliding of the anvils.

According to the method of this invention, a sufficient pressure is exerted on the billet from its surrounding before the extrusion pressure of the extrusion plunger is applied to it. Therefore, the billet is not collapsed by the extrusion pressure of the extrusion plunger, and the breakage of the billet in the extrusion process can be prevented. Furthermore, a hydrostatic force acts on the billet by the pressure from the surrounding and the extruding pressure to increase the ductility of the billet material.

Moreover, no special seal or other material is required to maintain the pressure inside the container, and this renders the operation easy. Another advantage is that hot processing can be easily carried out by the process of this invention.

EXAMPLE

Using an apparatus of the type shown in FIG. 1 including a container with an inside diameter of 40 mm, a pressurizing plunger with an outside diameter of 40 mm and an inside diameter of 20 mm and an extrusion plunger with an outside diamter of 20 mm, and a pressure transmitting medium obtained by compression molding of a mixture of equal amounts of pyrophyllite powder and molybdenum disulfide powder, a magnesium rod billet having a diameter of 17 mm was extruded at room temperature into a rod having a diameter of 7 mm. As a result, there was obtained an extrudate of good quality having a diameter corresponding with that of the die. The billet remaining in the container had the same cross-sectional shape and diameter as the original. This shows that the billet was uniformly pressurized form its surrounding, and that even a brittle material can be extruded without breakage by raising the pressure of the pressure medium through the insertion of the pressurizing plunger.

We claim:

1. A method for extruding a billet consisting of at least one material selected from the group consisting of metals, alloys, intermetallic compounds, ferrites and ceramics using an extruder including an extrusion die, an extrusion plunger and a container adapted to load the billet therein and extrude it therefrom, thereby to shape the billet to the configuration of the extrusion die; characterized in that said extruder further includes means for pressurizing said material loaded in the container as enclosed therein, and said method comprises embedding said billet, made in a smaller dimension in all directions than the dimension of the internal space of said container, in a solid pressure transmitting medium made of a material capable of being plastically deformed by the pressure exerted by said pressurizing means and having the configuration and dimension fitting to those of the internal space of said container, loading said pressure transmitting medium and said billet into the container, pressurizing said pressure transmitting medium and said billet by said pressurizing means, and then extruding said billet by the extrusion plunger while said pressure is maintained.

2. The method of claim 1 wherein said pressure transmitting medium and said billet are pressurized while enclosed in said container by means of a pressurizing plunger provided coaxially with said extrusion plunger so as to surround, and make contact with, the entire peripheral surface of said extrusion plunger and operating independently of said extrusion plunger.

3. The method of claim 2 wherein said pressurizing plunger is divided into two or more sections operating independently and coaxially from and with each other, the pressure transmitting medium is pressurized by means of a pressurizing plunger section on an outer side, and the pressure inside the container is maintained by a pressuring plunger on an inner side, during the operation of the extrusion plunger.

4. The method of claim 1 wherein said container is made of sliding anvils and the pressure transmitting medium and the billet are pressurized while enclosed in the container by the inward sliding action of said sliding anvils.

5. The method of claim 1 wherein said solid pressure transmitting medium is one obtained by compression molding of a powdery material so as to have a configuration and a dimension fitting to those of the space within the container, and have a space for embedding the billet therein.

6. The method of claim 1 wherein said solid pressure transmitting medium is one obtained by machining a lumpy material so as to have a configuration and a dimension fitting to those of the space within the container, and have a space for embedding the billet therein.

7. The method of claim 1 wherein said extrusion is carried out at room temperature.

8. The method of claim 1 wherein said extrusion is carried out hot.

9. The method of claim 8 wherein said pressure transmitting medium is made of an inner cylinder and an outer cylinder surrounding it, the billet is embedded in the inner cylinder and heated together with the inner cylinder, then the inner cylinder with the billet therein is accomodated in the outer cylinder loaded in the space of the container, and the billet is pressurized and extruded hot.

10. The method of claim 5 wherein said pressure transmitting medium is produced from a powdery material selected from the group consisting of molybdenum disulfide, pyrophyllite, talc, a mixture of alumina and molybdenum disulfide and a mixture of magnesia and molybdenum disulfide.

11. The method of claim 6 wherein said pressure transmitting medium is produced from pyrophyllite or talc in lump form.

12. The method of claim 1 wherein the sectional diameter of the extrusion plunger in a direction at right angles to the extrusion axis is substantially equal to that of the sectional diameter of the billet in said direction.

* * * * *